US005937446A

United States Patent [19]

Fallert

[11] Patent Number: 5,937,446

[45] Date of Patent: Aug. 17, 1999

[54] HELMET HAVING A BODY-FITTED PADDING AND DEVICE FOR PRODUCING THE SAME

[76] Inventor: Werner Fallert, Bachmatt 16, Sasbachwalden, Germany

[21] Appl. No.: 08/797,043

[22] Filed: Feb. 10, 1997

Related U.S. Application Data

[63] Continuation of application No. 08/435,620, May 5, 1995, abandoned, which is a continuation of application No. 08/118,650, Sep. 10, 1993, abandoned.

[30] Foreign Application Priority Data

Sep. 11, 1992 [DE] Germany ..... 92 12 247 U

[51] Int. Cl.[6] ..... A42B 3/06

[52] U.S. Cl. ..... 2/412; 2/411

[58] Field of Search ..... 2/9, 410, 411, 2/412, 413, 414, 415, 417, 418, 419, 420, 424, 425, DIG. 1, DIG. 3

[56] References Cited

U.S. PATENT DOCUMENTS 4,133,055 1/1979 Zebuhr ..... 2/411

FOREIGN PATENT DOCUMENTS 346608 12/1989 European Pat. Off. ..... 2/411
423711 4/1991 European Pat. Off. ..... 2/411
571065 11/1993 European Pat. Off. ..... 2/411
33 27 029 4/1984 Germany ..... 2/414
8401697 5/1984 WIPO ..... 2/411

*Primary Examiner*—Diana L. Biefeld
*Attorney, Agent, or Firm*—Oblon, Spivak, McClelland, Maier & Neustadt, P.C.

[57] ABSTRACT

Body-fitted padding having a padding adapter and device for the production thereof, in particular for a crash helmet, the adapter having a ventilation system. To this end a flexible covering consisting of a hood and a sleeve is provided which form an inner space to receive a curable impact and/or shock-absorbing material. The covering is here approximated to the contour of the protective article to be padded out or to be adapted and to that of the body part to be protected, so that, after curing of the material, the adapter can be laid in the protective article without modification of the contour of the side exactly matched to the body part.

9 Claims, 9 Drawing Sheets

HELMET HAVING A BODY-FITTED PADDING AND DEVICE FOR PRODUCING THE SAME

This application is a Continuation of application Ser. No. 08/435,620, filed on May 5, 1995, now abandoned, which is a continuation of application Ser. No. 08/118,650, filed on Sep. 10, 1993 also abandoned.

BACKGROUND OF THE INVENTION

1. Field of the Invention

The invention relates to paddings, for example for crash helmets, car seats or the like, which lie over relatively long periods of time directly against human limbs or body parts, a device for producing the padding, and a combination of a protective device, such as a crash helmet, and the padding.

2. Discussion of the Related Art

Such paddings are used preferably as resilient interior linings of articles of clothing made of rigid materials for the comfortable wearing of the article of clothing and to achieve a surface at the body side which is as far as possible adapted to the anatomy of the respective body part. However, it is also possible to use these paddings appropriately not only for lining conventional seats and couches, but also medical devices which are used, for example, for bearing and supporting the human skeleton and as a consequence constantly lie against the body.

The shock-absorbing or impact-absorbing property of padding materials already known from the prior art is utilized by specialists especially for improving the protective effect and the wearing comfort of protective equipment such as, for example, crash helmets.

A helmet lining of this generic type is disclosed for example in German Offenlegungsschrift 3 540 883. This known helmet lining of an integral crash helmet has a dimensionally stable, shock-absorbing outer lining in the form of a shell and an inner, soft, air-permeable lining which is arranged on the inner side of the outer lining.

The inner lining, together with the outer lining, forms a network of ventilation channels which are formed by intersecting radial depressions in the inner lining and also in the outer lining at the respective contact surfaces.

Furthermore, this integral crash helmet has in the lower lateral region two air traps which are arranged on both sides and make possible an air supply to the ventilation network via connecting channels. In an upper section of the helmet, a ventilation opening is correspondingly provided which is connected to the ventilation system, so that during travel an air circulation takes place, with air exchange of the fresh air in the channels with the moist air in the helmet interior region via the open-pored inner lining.

The resilience of the padding material which is used to adapt the helmet to a body shape and thus improve the wearing comfort, however, brings with it considerable disadvantages.

Thus, the soft padding of the head shape is accordingly compressed to different intensities, so that the ventilation channels in highly loaded regions can be blocked by the soft padding pressing in. The result of this is that, in these regions, no more ventilation of the inner helmet region takes place whereas in the remaining channels relatively high flow rates can be produced by the overall reduced flow cross-section, which leads to an uncomfortable feeling for the wearer. Furthermore, the relatively thin inner padding at the highly loaded regions is quickly pressed through as far as the outer dimensionally stable padding, as a result of which uncomfortable and painful pressure points can occur at the affected body part at these sections.

SUMMARY OF THE INVENTION

It is therefore the object of the invention to provide a protective or supporting object, for example a crash helmet, having a padding which, with improved safety properties, additionally provides greater wearing comfort.

According to the present invention, by the laying on or pulling over of a deformable, preformed covering having a cross-sectional thickness which, according to the advantageous further development of the subject of the invention, corresponds essentially to the subsequent soft padding, a virtually realistic deformation state of the subsequent entire padding can be simulated, such as occurs when the protective article is worn. To this end, as a result of the shape, which is approximated to a standard head or to the contour of the body part to be padded, of the covering according to the invention, the actual contour of the body part to be padded can be transferred virtually unaltered to the inner side of the lining adapter which is made of the curable material and, on its side facing away from the body, is already essentially matched, by the provision of the preformed sleeve, to the shape of the existing lining, to be adapted, of the protective article. By means of this special measure it is possible, after the completion of the lining adapter, to lay the latter on the existing lining without any change of the shape of the adapter being subsequently caused by this.

If the hood of the present invention is provided on its outer side with a number of projections, these projections extending in the longitudinal direction are ranged corresponding to the varying deformation of the covering in such a manner that the relative distances between in each case two adjacent projections enlarge themselves correspondingly in especially greatly deformed or stretched regions, thereby providing a larger contact surface for the inner padding on the dimensionally stable lining, without the flow cross-section, comprising the sum of all channels, being reduced overall. The throughflow of the flow channels, even after a further insertion of the lining adapter, can here be maintained without significant modification, as a result of the device designed according to the invention.

At this point attention is drawn to the fact that the more greatly deformed covering regions correspond essentially to the highly loaded padding regions according to the prior art.

In this manner, by means of the device according to the invention, a padding is provided whose surface contour, at the body side, corresponds exactly to that of the body part to be covered, the subsequent inner flow channels in the lining or in the lining adapter, avoiding the highly loaded regions and essentially following the lines of force of the surface force distribution to be expected. Because of the copying of the body part contour onto the body-side surface of the lining or of the lining adapter, the subsequent surface loading of the padding can be equalized during the wearing, so that no pressure points can occur.

A further development of the device according to the invention provides for the still plastically-deformable padding material for the lining or the lining adapter to be loaded during the shaping to fit the body, which loading corresponds substantially to the subsequent actual pressure loading. The simulation of the actual wearing state or loading state of the padding can thereby be further improved.

According to a further aspect of the invention, the simulation of the actual loading state is implemented in an advantageous manner in that the hard object to be adapted, during the curing phase of the applied or filled-in padding material for the lining or the lining adapter, is laid on under substantially realistic conditions until an adequate dimensional stability of the padding material permits the removal of the adapted object from the body part. This measure also has the advantage that an additional processing of the side, facing away from the body, of the lining for adaptation to the corresponding contour of the object to be padded can be dispensed with.

The design of the projections as separate components has the further advantage that, with low outlay, any flow channel patterns having different channel cross-sections can be produced.

According to the present invention, it is provided to divide the dimensionally stable lining into an inner and an outer lining shell, each lining shell being independently produced and subsequently inserted one inside the other. By means of this measure according to the invention, it is possible to produce the crash helmet with a predetermined oversizing of the outer lining shell, in order subsequently, by means of the inner lining shell which is produced once and acts virtually as an adapter, to adapt each helmet individually, without subsequent modification of the helmet geometry and adapter geometry or of the flow channels incorporated into the inner lining shell, to the particular head shape of the wearer.

If the lining adapter according to the invention is designed with a ring and at least one rods the additional arrangement of ribs on the outer side of the hood can be dispensed with. In this case it is also unnecessary to remove the covering from the cured shock-absorbing material, thus ensuring a smooth surface of the adapter.

By means of the design of the holding device between the two lining shells, the helmet can be individually brought into any position relative to the inner lining shell, according to the requirements of the wearer, and subsequently be fixed with the outer side of the inner lining shell on the inner side of the outer lining shell. It is naturally conceivable that, instead of the holding device in the form of interlocking projections and recesses on the contact surfaces of the lining shells, a touch-and-close fastening or adhesive bond can, for example, be provided. With suitable dimensioning of the two lining shells, the fixing of the helmet on the inner lining shell can also be effected simply by means of a press fit.

The invention is explained in greater detail below with the aid of preferred exemplary embodiments with reference to the drawings.

DESCRIPTION OF THE PREFERRED EMBODIMENTS

Figure 1A:
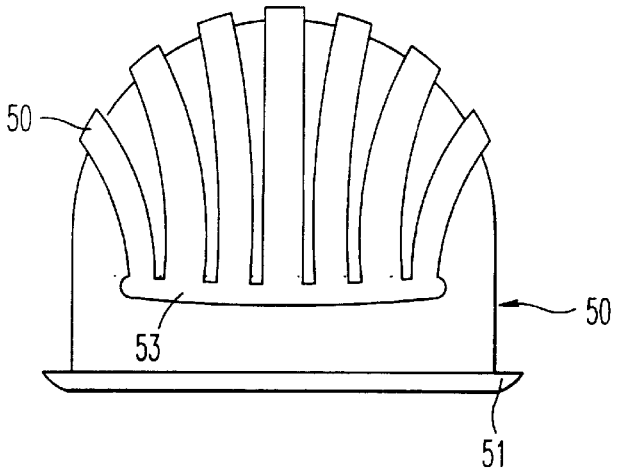
FIGS. 1 and 1*a* show a covering designed according to the invention in the form of a hood for adapting a padding to a head shape, according to one of the exemplary embodiments of the invention.
Figure 1B:
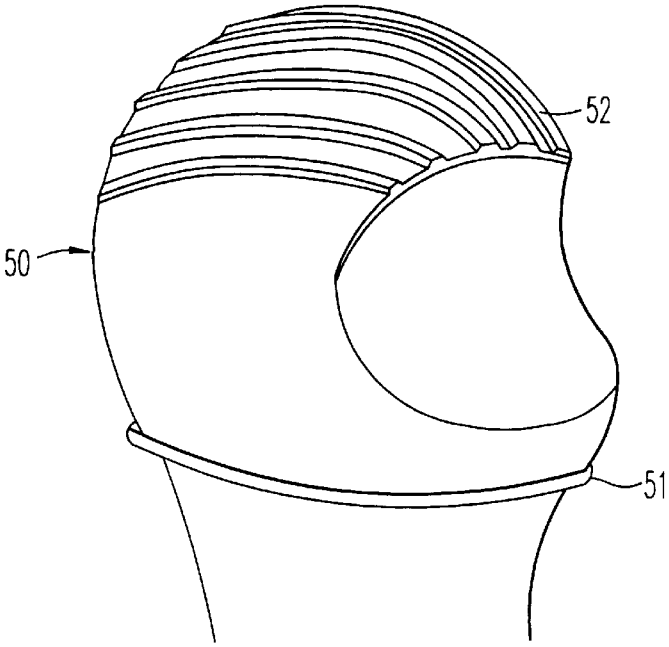

FIG. 1 shows a first exemplary embodiment of the device according to the invention for producing a body-fitting padding, a covering being provided which is designed in the form of a hood 50 for adapting a lining 8 to a head shape. The hood 50 consists of an elastically deformable material, preferably of a rubber material, which is shaped, corresponding to a helmet upper part 1 of an integral crash helmet according to FIGS. 3 or 6, to form a shell with a standard head size, the edge contour of which shell, in side elevation, substantially follows the contour of the helmet upper part 1. The outer edges of the flexible hood 50 are bent over to form a semicircular channel 51 which surrounds the hood 50 as a closed circular ring. The outer side of the hood 50 has a number of projections 52 which are substantially uniformly spaced and in each case extend from a front shell edge facing the face, over the outer side of the hood 50, towards the rear shell edge facing the neck. The projections 52 are here designed in one piece with the hood 50 and are of the same hood material.

However, it is also possible to produce the projections 52 separately from a flexible material, for example from rubber, and to apply them as required in any alignment onto the outer side of the hood 50. Suitable fastening possibilities for the projections 52 can, for this case, be a plug connection according to the stud-eyelet principle or a simple touch-and-close fastening. However, other fastening variants such as adhesion bonding or welding can be used.

Each projection 52 has a trapezoidal cross-sectional surface with a height of approximately 2 to 4 mm and an average width of approximately 10 mm. In the rear section of the hood 50, a further projection 53 is formed which intersects the projections 52, which are spaced uniformly, at a right angle, forming a circular segment at the shell-shaped hood 50. The hood 50 has, between two adjacent projections 52, a wall thickness corresponding substantially to the cross-sectional thickness of an inner, soft padding 9 of the integral crash helmet to be lined.

The device according to the invention, according to the first exemplary embodiment, is furthermore complemented by a sleeve 60 made of a flexible material such as, for example, rubber which is laid against the side, facing away from the body, of the hood 50. This sleeve 60 is, according to FIGS. 2*a* to 2*c,* a type of second hood, which, together with the hood 50, forms an inner or hollow space and is already preformed corresponding to a standard head or corresponding to the concave surface of the helmet to be adapted.

Figure 3:
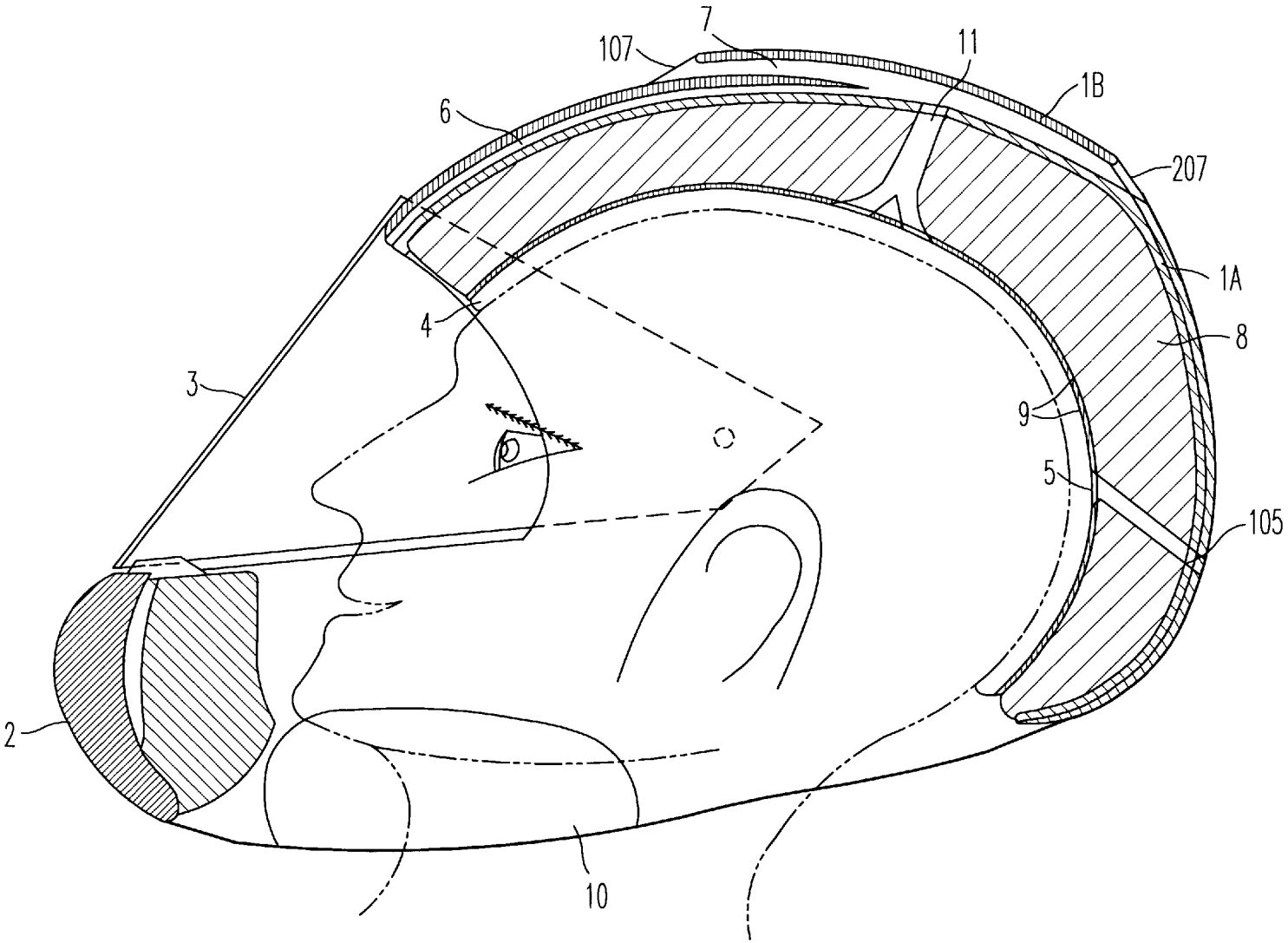
FIG. 3 shows the side elevation of an integral helmet according to a first embodiment with a padding produced with the device according to FIGS. 1, 1*a* and 2*a* to 2*c;*
Figure 4:
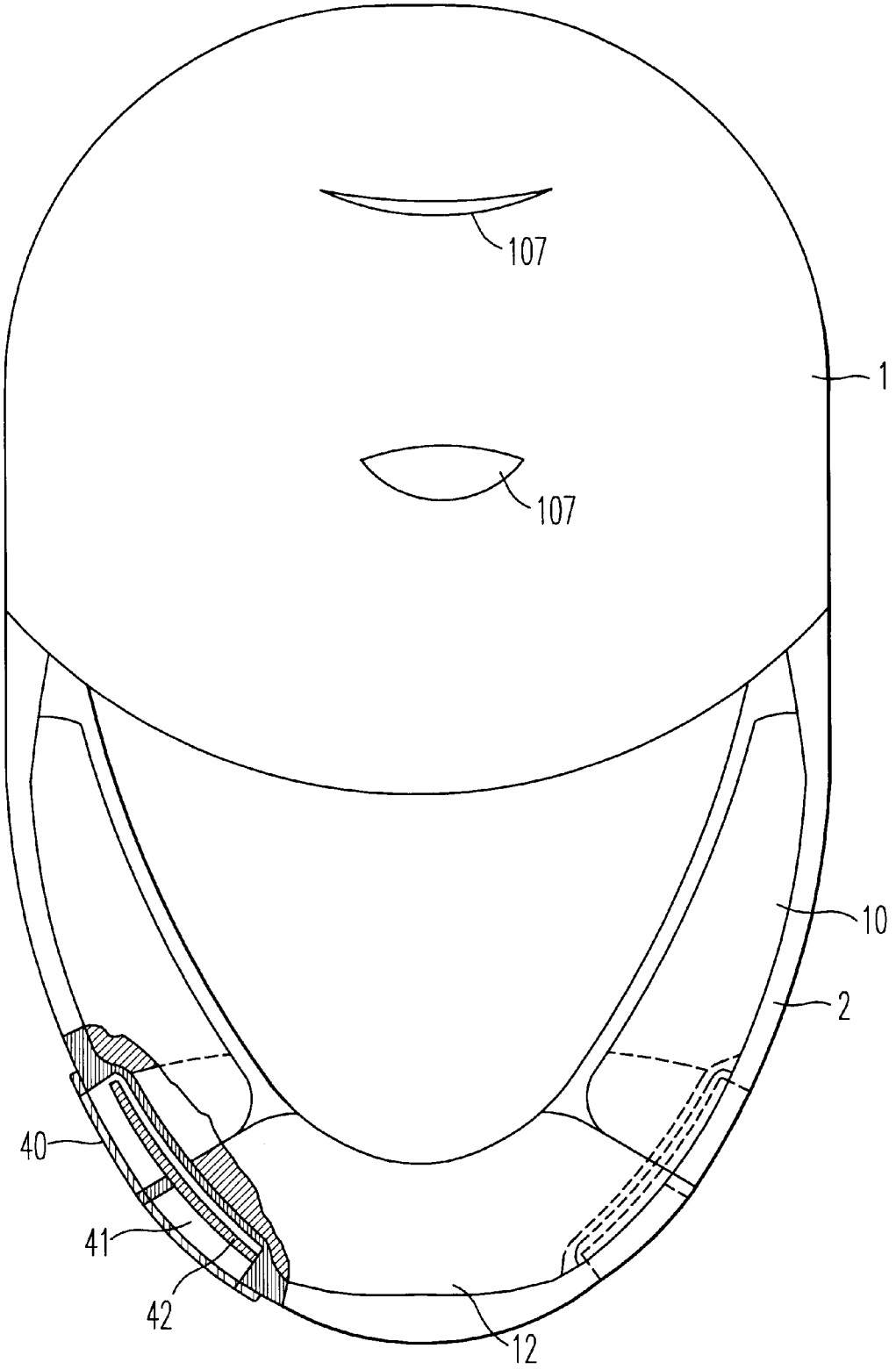
FIG. 4 shows a plan view of the integral helmet according to FIG. 3.
Figure 5:
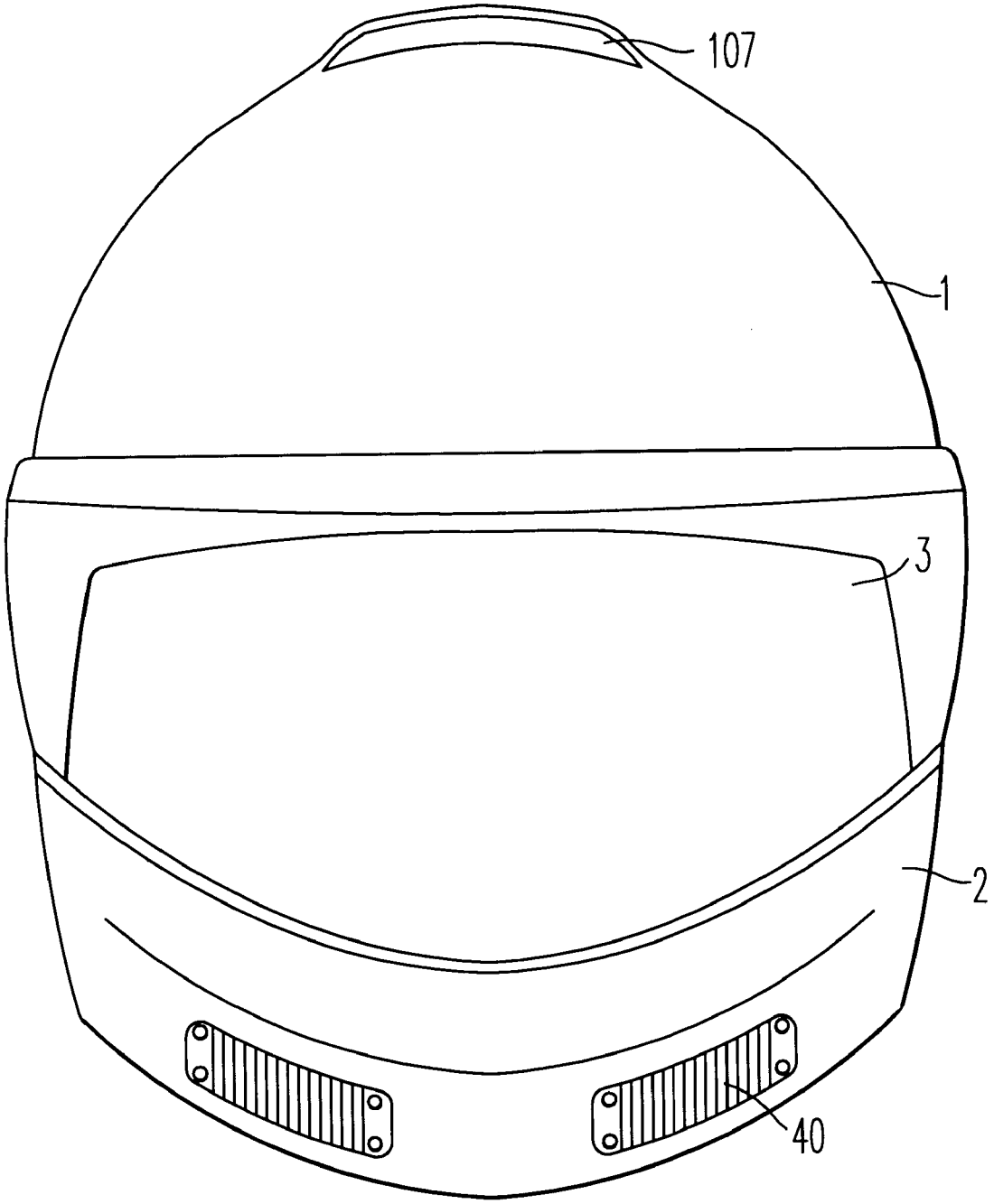
FIG. 5 shows a front view of the integral helmet according to FIG. 3.

The integral crash helmet to be adapted has, according to FIG. 3, a helmet lower part 2 and a helmet upper part 1 with a hard outer shell which comprises, for example, carbon fiber-reinforced synthetic resin and consists of an inner and an outer partial shell 1*a,* 1*b* according to a sandwich design generally known from the field of lightweight construction.

On the inner side of the inner partial shell 1*a* there is located a shock-absorbent lining 8 of a dimensionally stable material, for example a foamed synthetic resin, on the inner side of which a soft padding 9 consisting of an open-pored synthetic resin foam or an air-permeable and moisture-permeable textile, for example Goretex, is again arranged. Between the soft padding 9 and the dimensionally stable lining 8, an inner channel system for ventilation of the helmet interior is arranged, which channel system, in conjunction with the air-permeable and moisture-permeable padding 9, makes possible an air circulation.

The inner channel system is formed by a multiplicity of inner flow channels 4 which are shaped in the dimensionally stable lining, distributed substantially over the entire circumference of the lining, and in part at the front edge of the helmet upper part 1 open into a helmet inner space between the front face half and a visor device 3 and, avoiding highly loaded or deformed regions, extend essentially parallel to a rear region of the helmet upper part 1. In this region the inner flow channels 4 are delimited by a collecting channel 5 which intersects the inner flow channels 4 at a right angle, to form a circular segment-shaped section. The collecting channel 5 here has in each case a channel connection to at least one air inlet opening 105 which is arranged in the neck region of the helmet upper part 1 and makes possible a ventilation of the back-of-the-head region within the helmet upper part 1.

Between the outer and the inner partial shell 1*a,* 1*b,* an outer channel system is provided in the front section of the integral helmet, which outer channel system is formed by a number of longitudinally extending outer flow channels 6 which are substantially uniformly spaced and in part at the front edge of the helmet upper part 1 also open into the inner space between the front face half and the visor device 3. The outer flow channels 6 open in an upper region of the helmet upper part 1 into a main air channel 7 which, having an air-inlet opening 107 aligned towards the front side of the integral helmet, is designed in one piece with the outer partial shell 1*b,* and is continued in the opening region of the outer flow channels 6 between the two part-shells 1*a,* 1*b.*

The lining 8 of the helmet upper part 1 is further provided, in the orifice region of the outer flow channels 6, with a number of transverse channels 11 which produce a connection between the inner flow channels 4 and the main air channel 7.

The main air channel 7 terminates in at least one air outlet opening 207 which is arranged in the rear region of the helmet upper part 1. The air outlet opening 207, which is preferably arranged in a region of the helmet upper part 1 around which air flows in a turbulent manner has, overall, a larger flow cross-section than the air-inlet opening 107 of the main air channel 7 which, in the entire orifice region of the outer flow channels 6 and of the transverse channels 11, has a cross-sectional constriction. The cross-sectional proportions over the length of the main air channel 7 depend essentially on the entire flow cross-section of the outer flow channels 6 and of the transverse channels 11 and can be determined such that, in the constricted orifice region, a reduction of the back pressure into a subatmospheric pressure range can be achieved by increasing the flow rate. It is thus ensured that, for example, with a closed visor device 3 and accordingly a pressure level in the outer flow channels 6 and transverse channels 11 which corresponds to the external pressure, a suction effect always results with the utilization of the Venturi tube effect, which suction effect brings about better air circulation through the soft padding 9.

Since, however, when the integral helmet according to the invention is actually worn, a flow separation at the air-inlet opening 107 or a reduced flow rate in the main air channel 7, for example as a result of pivoting the helmet with respect to the incident flow direction, must be taken into account, in this case a flow reversal may take place which would lead to a ventilation of the helmet inner space via the transverse channels 11 and outer flow channels 6. In order, in this case, to prevent an uncomfortable lifting of the helmet on account of a possible air pressure build-up, the at least one rear air-inlet opening 105 is provided for the collection channel 5, via which air-inlet opening a possible pressure rise within the helmet upper part 1 can be relieved.

The helmet lower part 2 of the integral crash helmet is also provided on the inner side with a padding 10 which almost seals the helmet inner space in the throat and neck region. Furthermore, the helmet lower part 2 is designed in one piece with a chin protection in which a controllable ventilation device 40 is provided. The ventilation device 40 is formed by a plurality of ventilation slits in the chin protection which produce a laminar air flow for ventilation and dehumidification of the visor device. The air which has flowed in is subsequently, as already described, removed via the outer and inner channel system in the lining 8 of the helmet upper part 1. In the ventilation device 40, a microfilter 42 for cleaning and dehumidifying the flowing-in air is furthermore provided, which microfilter is accommodated in an air passage 41 in the front chin-protection half.

Figure 6:
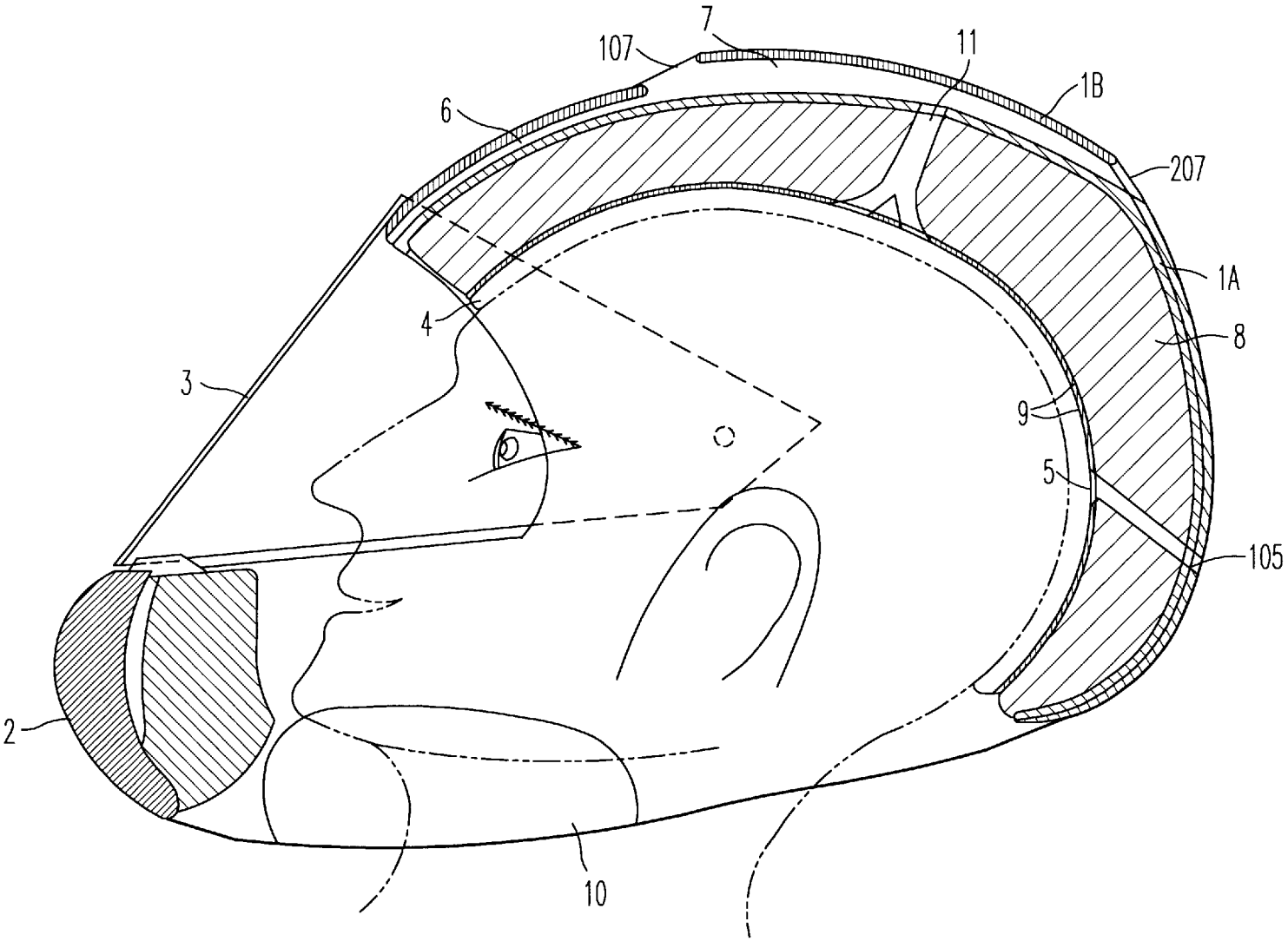
FIG. 6 shows the side elevation of an integral helmet according to a second embodiment with a padding produced according to FIGS. 1, 1*a* and 2*a* to 2*c* using the device according to the invention.

FIG. 6 shows a further embodiment of an integral crash helmet in which the padding according to the invention can be provided. In this embodiment the at least one outlet opening 207 is integrated in a division edge 16 which is designed over substantially the entire radius of the helmet upper part 1 and produces an artificial flow division to form a zone around which air flows in a turbulent manner.

Figure 2A:
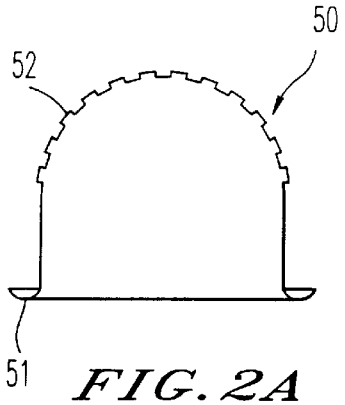
FIGS. 2*a* to 2*c* show the hood from FIGS. 1, 1*a* in conjunction with a sleeve in order to illustrate an advantageous production device.
Figure 2B:
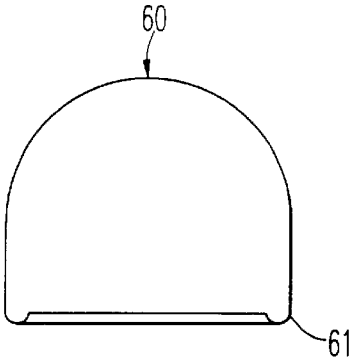
Figure 2C:
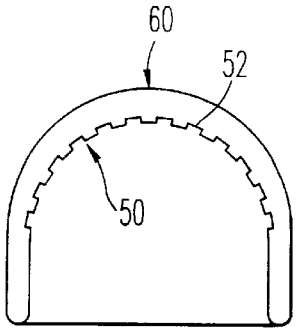

The production and adaptation of the body-fitted padding for the above-described integral helmet having a device according to the first exemplary embodiment of the invention is effected with reference to FIGS. 2*a* to 2*c* in the following manner:

After the hood 50, in the case of separately produced projections 52 for the formation of the above-described inner channel system pattern, has been provided with the projections 52 in each case shortened to the appropriate length, the hood 50 is inverted over the head of a person and aligned corresponding to the subsequent seating position of the integral helmet to be padded out. Subsequently the sleeve 60, which corresponds essentially to the shape of the inner partial shell 1*a* to be padded and to a standard head, is placed on the hood 50 in such a manner that it closes tightly against the outer annular channel 51 of the elastic hood 50 and in the process forms the inner space to be filled with foam. The height of the inner space can be determined by means of distance pieces, not illustrated, which are inserted between the hood 50 and the sleeve 60 or into the hollow space. The height corresponds substantially to the thickness of the lining 8. However, it is also possible to use an already semi-finished lining 8 as sleeve 60, the height of the inner space being adjusted corresponding to the still-absent thickness of the lining 8. That is to say that, for example, a conventional helmet having a certain oversize can be adapted in this manner and can be equipped with the inner channel system.

In the case in which a helmet is used without the aforementioned sandwich design, the outer side of the hood 50 is covered with a foamed synthetic resin which is modulated corresponding to the shell shape of the helmet upper part 1. The sleeve 60 is then drawn over the still-deformable synthetic resin, which sleeve 60 is now provided on the inner side with projections aligned corresponding to the above-described outer channel system. This second sleeve 60 accordingly corresponds, apart from the different projection arrangement, to the inverted first hood 50, it being possible correspondingly to align the channel surrounding the sleeve 60 in an annular manner also on the inner side of the inverted hood 50. That is to say that when the second sleeve 60 is pulled over, the annular channels of the hood 50 and of the sleeve 60 can be brought into contact in one another, forming a tight seal, so that a lateral escape of the foamed synthetic resin can be prevented. It is naturally also possible to design the hood and sleeve directly as one piece during their production. In order to obtain an even better fit, the hard outer shell of the helmet upper part 1 is finally pressed onto the outer sleeve 60 and held in place.

After the foamed synthetic resin has cured or crosslinked to the extent that it can maintain the introduced shape stably, the helmet upper part 1 is removed and the two hoods 50, 60 removed from the final lining 8. Corresponding to the projections 52 on the outer hood side facing away from the body or, if appropriate, on the inner sleeve side, depressions have formed on the surface of the lining 8 which are now connected to one another by means of a plurality of passage bores, corresponding to the abovementioned transverse channels 11. In order, during the pulling off operation, actually to avoid a contour modification in particular on the inner side of the lining, it has proven especially advantageous to design the covering, that is to say the hood 50 and/or the sleeve 60, in two layers, only the outer hood layer and/or sleeve layer being pulled off, while the inner hood layer and/or sleeve layer remains on the foamed synthetic resin. It naturally goes without saying that the ribs in this case are formed only on the layer, to be pulled off, of the hood 50 and/or of the sleeve 60. For the case in which the covering 50, 60 is only made of a relatively thin rubber material or in which production costs are to be saved, the covering 50, 60 can also remain on the foamed synthetic resin.

When the lining material has completely cured, the lining 8 is fitted into the outer shell of the helmet upper part 1 and provided on the inner side with the soft padding 9.

Figure 7:
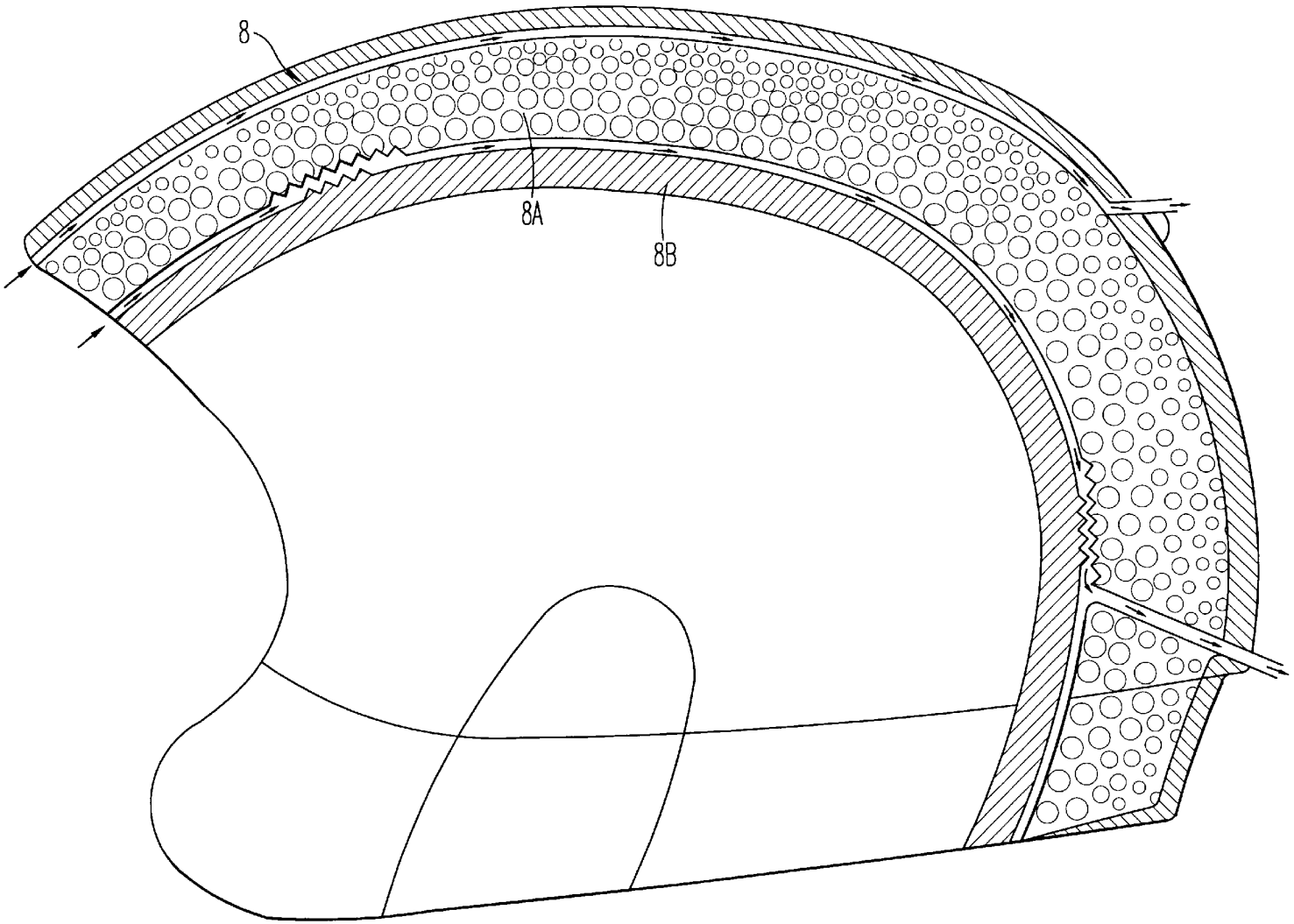
FIG. 7 shows the side elevation of an integral helmet with a padding according to a second exemplary embodiment of the invention.

The mode of construction of the padding, according to a second exemplary embodiment according to FIG. 7, corresponds essentially to the above-explained production process. In this case, however, the dimensionally stable lining 8 consists of an outer lining shell 8*a* and an inner lining shell 8*b* which are pushed into one another to form the entire lining 8. The outer lining shell 8*a* is produced with a predetermined oversizing with respect to the spherical radius of its inner side and thus permits the adaptation of the finished crash helmet to the head shape of a wearer by arrangement of an adapter. The adapter is, in the second exemplary embodiment according to the invention, represented by the inner lining shell 8*b* which is preferably produced by the above-described device. Here, the inner lining shell 8*b* is designed on its outer side with a number of transversely extending projections or ribs holding device which preferably arrange themselves in a front and rear region of the helmet shell. Corresponding to these projections, a number of depressions or recesses are incorporated on the inner side of the outer lining shell 8*a,* into which depressions or recesses the projections are engaged in a form-locking manner when the two lining shells are pushed into one another. It should also be noted here that a larger number of recesses are provided than projections, so that the helmet outer shell, in order to improve the comfort in wear, can be fixed individually in a certain seating position with respect to the inner lining shell 8*b* and thus with respect to the head of the wearer. This exemplary embodiment accordingly makes possible the adjustment of the seating position in a grid-like manner in dependence on the size of the projections or recesses. However, in order to make possible a continuous adjustment of the seating position of the helmet, the projections and recesses can be replaced, for example, by a touch-and-close fastening.

Figure 8:
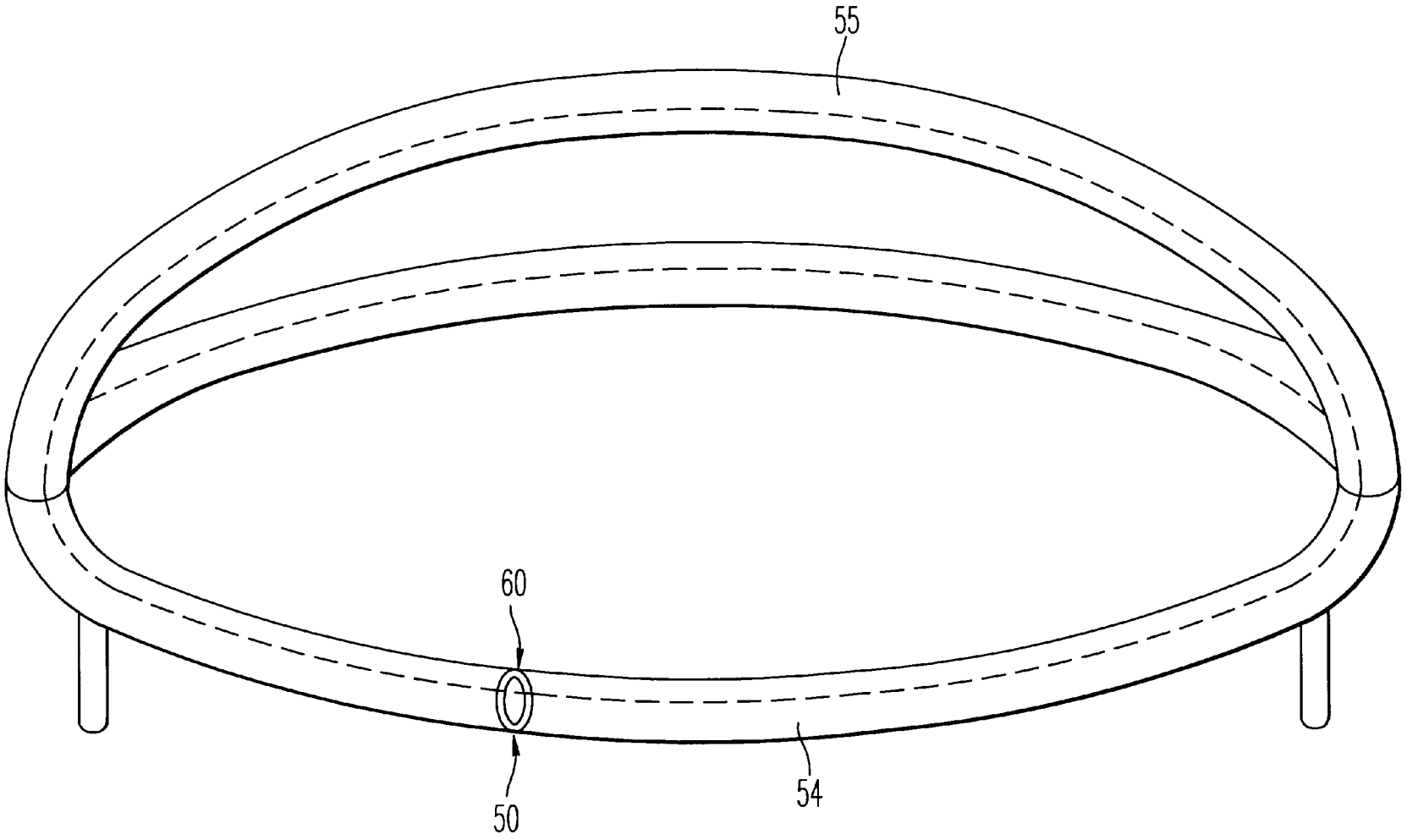
FIG. 8 shows a device for producing a padding according to a third exemplary embodiment of the invention.

A third exemplary embodiment of the device according to the invention can, furthermore, be taken from FIG. 8. According to this exemplary embodiment, the device has, for the production of an adapter for adapting a commercially available oversized crash helmet, a covering in the form of a hood 50 which, together with a sleeve 60 pulled over it, forms, in one piece, inter alia, an annular tube 54 consisting of a flexible material, preferably rubber, onto which at least one further tube piece 55 in a diagonal of the tube ring 54 is connected in one piece. The inner space of the annular tube 54 is here in fluid connection with the inner space of the tube piece 55. The length of the tube piece 55 formed in one piece by the hood 50 and the sleeve 60 is furthermore chosen such that the tube piece 55 undergoes a bulging out between the connection points to the annular tube 54, forming a spherical or dish-shaped form, which is substantially matched to a standard head or to the inner spherical radius of the already existing lining of the helmet to be adapted.

In this embodiment, the inner air channels are already formed by the gaps or free spaces between the annular tube 54 and the diagonally extending tube piece 55, that is to say that in the widest sense, the ribs are formed by the individual spaced-apart tube walls of the hood 50 and of the sleeve 60, so that the additional design of the hood 50 with outer ribs, such as is provided according to the first embodiment with a closed hood and sleeve, can be optionally provided in this embodiment only as a supplementary measure or can also be omitted.

It is also pointed out at this point that a plurality of tube pieces extending in parallel or at angles to one another can also be provided, thereby increasing the contact surface of the subsequent adapter with the head of the wearer and increasing the number of ventilation channels.

For the production of the padding adapter, the tubular covering 50, 60, as in the first exemplary embodiment, is pulled directly over the head of the subsequent helmet wearer and the helmet to be adapted is placed on. In order to adapt the crash helmet, the still-flowable foamed synthetic resin is subsequently forced into the hollow space of the covering 50, 60 until the individual spacings between the existing helmet lining and the head are balanced out. After curing of the synthetic resin to form the dimensionally stable inner lining, the helmet can then be removed and the inner lining be adhesively bonded into the helmet either after the covering 50, 60 has been pulled off or simply together with the covering 50, 60. The covering of the helmet adapter by the existing soft inner padding ends the adaptation process to the individual head shape of the wearer.

It is again pointed out here that the adaptation of a helmet can be carried out as often as required, always with the same adapter without the geometry of the adapter being substantially modified or having to be adapted again to the head shape of the same wearer. Slight deviations in geometry of different helmets can accordingly be compensated by the choice of a suitable adapter material with a corresponding flexibility without post-working of the adapter, without the contour of the inner side of the adapter changing.

Figure 9:
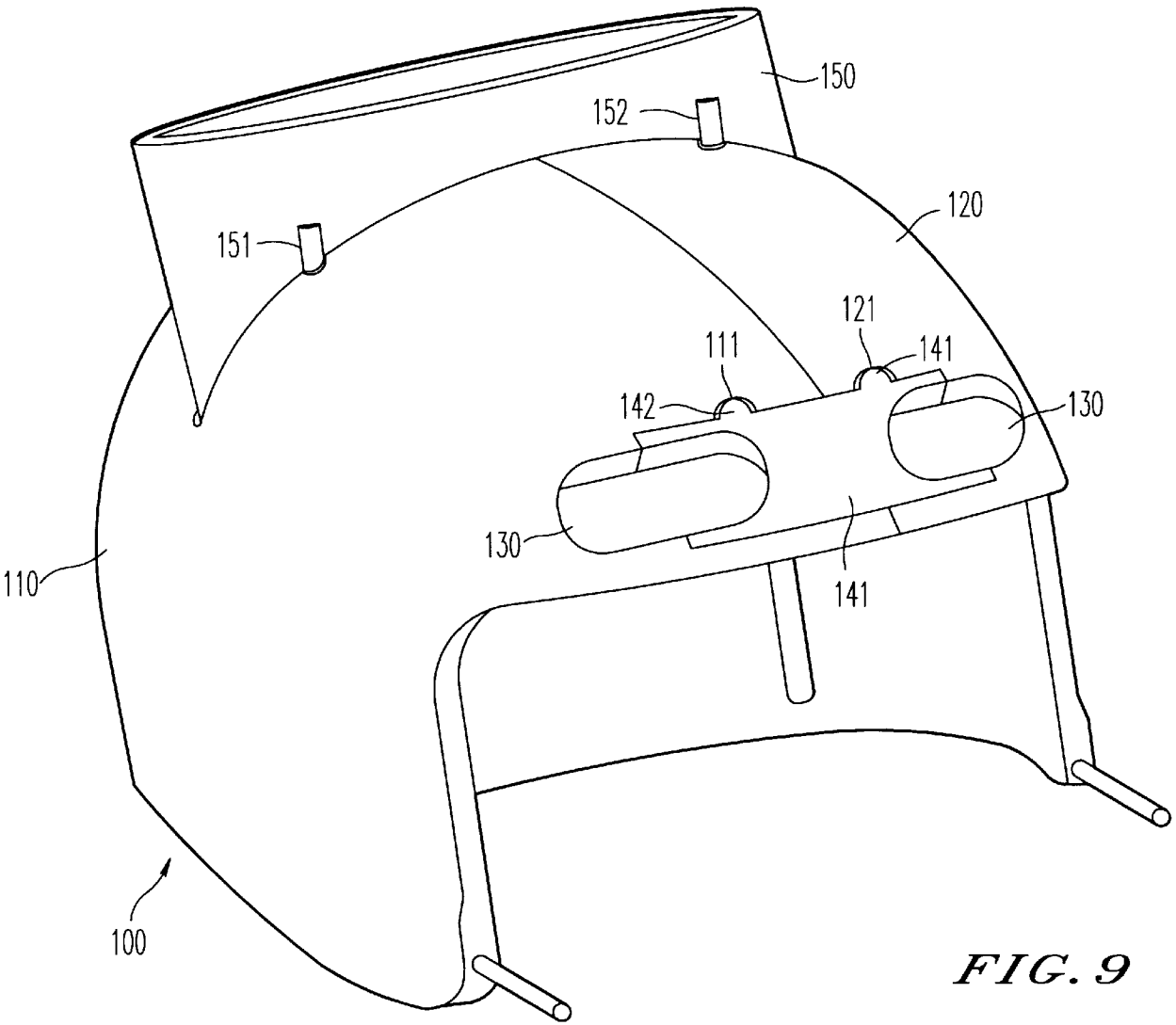
FIGS. 9 and 10 show templates or models for producing the deformable covering according to the three exemplary embodiments.
Figure 10:
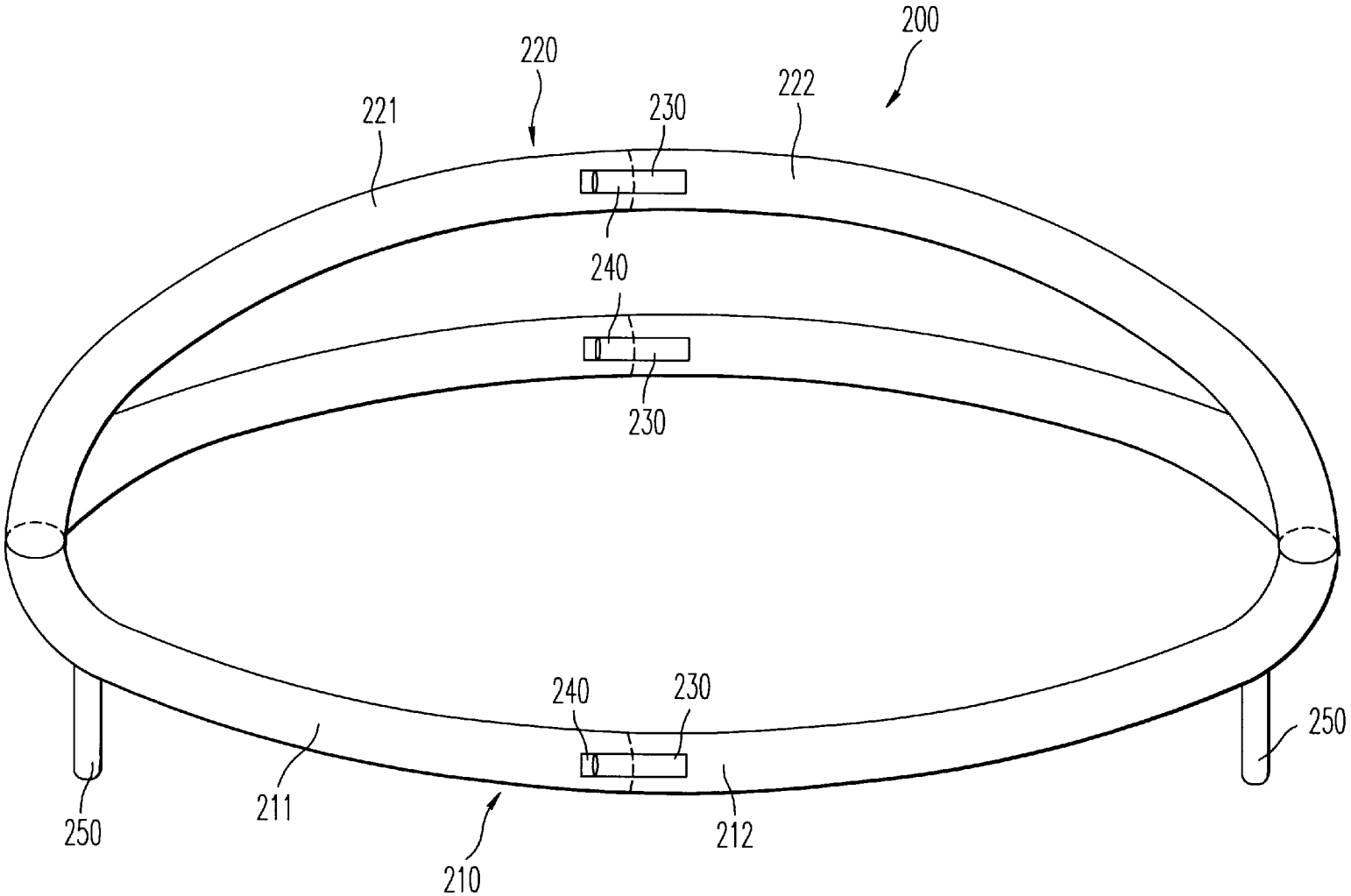

FIGS. 9 and 10 show templates or models which can be used for producing the deformable covering or the flexible hood and sleeve according to the first, second and third exemplary embodiments of the invention.

According to FIG. 9, the model for producing the covering consisting of hood 50 and sleeve 60, according to the first or second exemplary embodiment, consists of a shell 100 substantially in the contour of the inner lining, to be subsequently produced, of the crash helmet or of the adapter, preferably consisting of a pure or alloyed aluminium. The shell is divided into two shell elements 110, 120, the plane of division extending essentially vertically through the center point of the helmet concave surface and in the direction of view of the wearer. In the front end region of the model, in each case a recess 130 in the form of notches on the mutually opposing lateral edges are incorporated on the two shell elements 110, 120, which notches produce an elongated hole when the shell elements 110, 120 are assembled. Into this elongated hole an H-shaped clip 140 can be inserted which also has notches on two end sections. These notches, together with the notches in the shell elements, form in each case an elongated hole. At a lateral edge of the clip 140, projections 141, 142 are further provided which engage in correspondingly designed notches 111, 121 on the shell elements 110, 120 and thus clamp the elements together. The two elongated holes are either covered on both sides by means of a thin plate, not shown, or a pin in each case is inserted into the elongated holes, the length of which pin is slightly larger than the thickness of the model.

On the top side of the model, the shell has a continuous recess into which a base element 150 which, for reasons of weight, is preferably hollow is inserted, which base element 150 projects beyond the outer side of the shell. The base element 150 is designed with two lateral projections 151, 152 which engage in corresponding notches on the shell elements 110, 120 and thereby hold the shell elements 110, 120 together at the upper side in the manner of a clip. For the exact positioning of the shell elements 110, 120 relative to one another, a number of location pins are located on the contact surface of one element 110, which locating pins can be fitted into bores on the contact surface of the opposite shell element 120. Furthermore, a number of additional pins of specific thickness are arranged on in each case one lateral edge of the individual shell elements 110, 120.

For the production of the covering 50, 60 according to the invention, the above-described model is immersed in a liquid rubber solution or a similar substance and the rubber-covered model is dried. Thereupon the rubber covering is cut open around the base element 150, so that an opening is produced from which the end-face clip 140, the base element 150 itself and the individual shell elements 110, 120 which are now folded open can be individually removed. The excess rubber at the edge of this opening serves subsequently for closing the opening, while the tube stubs formed by the pins are provided for introducing the foamed synthetic resin. If pins were inserted in the end-face elongated holes 130, after their removal corresponding passage openings have formed in the covering, which openings subsequently serve as air-inlet openings for the inner ventilation system of the helmet.

FIG. 10 shows a model for producing the adapter according to the third exemplary embodiment.

This model 200 has a hoop or ring 210 which is preferably made of aluminium and is split at opposite points. At least one further crescent-shaped or arcuate rod is connected in one piece to the ring, which rod connects the two ring parts 211, 212 together to form a type of shell. The rod, too, is split into two at a point such that the plane spanned by all partial points extends vertically through the theoretical center point of the shell and transversely to the direction of view of the subsequent helmet. At the respective ends of the two rod halves 221, 222 and of the two ring parts 211, 212, locating pins 230 or bores 240 are provided, so that an exact positioning of the individual halves and parts is possible. Furthermore, as in the model according to FIG. 10, a number of additional pins 250 are provided on the ring parts 211, 212, which additional pins 250 shape the tube pieces for filling in synthetic resin.

In order to produce the adapter, the model 200, as already described above, is immersed in a solution of rubber or a comparable material. After drying out of the covering, the latter is partly cut open at the edge of the aluminium ring 210 and the two model parts are removed individually from the rubber covering. Subsequently the cut points of the covering are welded or adhesively bonded again.

In conclusion, it is pointed out that the invention can by no means be applied only to the production of the inner lining of a crash helmet. Rather, all kinds of paddings in which an anatomical adaptation to a body section to be padded is advantageous can be formed by the device according to the invention. Seats in motor vehicles, for example, can, by a corresponding additional padding covering produced as explained above, be improved in their seating quality. In this case the padding produced according to the invention would then correspond to a type of seat padding adapter which is simply laid on the already existing vehicle seat. Naturally, however, the actual seat padding can also be produced in the above-described manner. The possibility also exists of applying the device of the invention to the shaping of wheelchair seats and other surgical auxiliary appliances.

The invention accordingly relates to a body-fitted padding with a padding adapter and device for the production thereof, in particular for a crash helmet, the adapter having a ventilation system. To this end a flexible covering consisting of a hood and a sleeve is provided which form an inner space to receive an impact and/or shock-absorbing material. The covering is approximated to the contour of the protective article to be padded out or to be adapted and that of the body part to be protected, so that the adapter can, without changing the contour of the side matched precisely to the body part, be repeatedly inserted into or removed from the protective article.

I claim:

1. A crash helmet comprising:

inner and outer partial shells;

a stable shock absorber liner made of foamed synthetic resin inserted into one of said shells, said shock absorber liner being clad on an inner side by a soft, resilient padding for comfortable wearing of the helmet;

wherein:

said liner includes an inner, dimensionally stable helmet adapter which comprises a plurality of inner channels for ventilation of an interior of the helmet between said soft resilient padding and said shock absorber liner, an inner side of said helmet adapter being individually adapted so as to match an actual contour of a user's head for adaption of the helmet to an individual head shape of the user, wherein the inner side of the helmet adapter defines a final shape which matches the contour of a user's head and applies an equalized surface loading to a user's head.

2. A crash helmet according to claim 1, wherein:

said helmet adapter comprises an inner shock absorber lining shell having the channels at an inner side thereof facing said soft resilient padding.

3. A crash helmet according to claim 2, wherein:

said helmet adapter has on an inner side thereof said channels and said channels comprise a plurality of longitudinally extending inner flow channels opening on a front edge of said shock absorber liner, said flow channels being covered by said soft, resilient padding.

4. A crash helmet according to claim 3, wherein:

between said inner and outer partial shells a plurality of outer flow channels are located which form an outer ventilation system.

5. A crash helmet according to claim 1, wherein said helmet adapter is attached to said outer shell by a holding device.

6. A crash helmet according to claim 5, wherein said holding device comprises projections on one of said helmet adapter or said shock absorber liner which cooperate with recesses on the other of said helmet adapter or said shock absorber liner to lock said shock absorber liner to said helmet adapter, wherein the number of recesses is greater than the number of projections to permit a positional adjustment between said shock absorber liner and said rigid helmet adapter.

7. A crash helmet comprising:

an outer shell;

a stable shock absorber liner made of foamed synthetic resin inserted into said shell, said shock absorber liner being clad on an inner side thereof by a soft, resilient padding for comfortable wearing of the helmet;

wherein:

said liner includes an inner, dimensionally stable helmet adapter which is made of foamed synthetic resin and is individually adapted so as to match an actual contour of a user's head for adaptation of the helmet to the individual head shape of a user, wherein the inner side of the helmet adapter defines a final shape which matches the contour of the user's head and applies an equalized surface loading to a user's head, such that the final shape of the inner side of the helmet adapter is maintained as the helmet is repeatedly removed from and placed on a user's head, said rigid helmet adapter including a ring and at least one rod is connected to said ring and is convex essentially perpendicularly to a plane spanned by said ring and said at least one rod, so that, between said ring and said at least one rod, empty spaces are produced which form inner flow channels between said shock absorber liner and said soft, resilient padding.

8. A crash helmet according to claim 7, wherein:

said helmet adapter is attachable to an outer lining shell by a holding device.

9. A crash helmet according to claim 8, wherein said holding device comprises projections on one of said helmet adapter or said shock absorber liner which cooperate with recesses on the other of said helmet adapter or said shock absorber liner to lock said shock absorber liner to said helmet adapter, wherein the number of recesses is greater than the number of projections to permit positional adjustment between said shock absorber liner and said helmet adapter.

* * * * *